United States Patent [19]

Waugh

[11] 4,292,827

[45] Oct. 6, 1981

[54] METHOD FOR MAKING DECORATIVE EMBLEMS

[75] Inventor: Robert E. Waugh, Columbus, Ohio

[73] Assignee: The D. L. Auld Company, Columbus, Ohio

[21] Appl. No.: 54,548

[22] Filed: Jul. 5, 1979

Related U.S. Application Data

[63] Continuation-in-part of Ser. No. 903,829, May 8, 1978, abandoned.

[51] Int. Cl.[3] ..... B21D 28/06; B21D 53/44

[52] U.S. Cl. ..... 72/46; 29/412; 29/527.2

[58] Field of Search ..... 427/258, 270, 424, 289, 427/267, 268, 293; 118/315; 428/203, 204; 29/412, 527.2; 72/46

[56] References Cited

U.S. PATENT DOCUMENTS

| | | | |
|---|---|---|---|
| 1,215,675 | 2/1917 | Lynch | 29/412 X |
| 2,244,565 | 6/1941 | Nast | 428/162 |
| 2,931,119 | 4/1960 | Gits | 428/64 |
| 3,075,249 | 1/1963 | Sucher | 264/255 |
| 3,114,597 | 12/1963 | Lee | 264/1 |
| 3,246,066 | 4/1966 | Gits | 264/132 |
| 3,431,889 | 3/1969 | Fraatz | 118/315 |
| 3,654,062 | 4/1972 | Loew | 428/164 |
| 3,725,112 | 4/1973 | Hansen | 428/13 |
| 3,875,893 | 4/1975 | Riley | 118/710 |
| 4,034,708 | 7/1977 | Fielder et al. | 118/642 |
| 4,100,010 | 7/1978 | Waugh | 156/242 |
| 4,139,654 | 2/1979 | Reed | 427/44 |

FOREIGN PATENT DOCUMENTS

| | | |
|---|---|---|
| 1652329 | 4/1971 | Fed. Rep. of Germany . |
| 2506462 | 9/1976 | Fed. Rep. of Germany . |
| 1549303 | 12/1968 | France . |

OTHER PUBLICATIONS

Schwartz et al., *Surface Active Agents*, Interscience Publishers, Inc., New York, 1949, pp. 256–257.

Sears, F. W. et al., *University Physics*, third edition, Addison-Wesley Publishing Co., Reading, Massachusetts, 1964, p.306.

Jones, F. D., *Die Design and Diemaking Practice*, Third Edition, The Industrial Press, New York, 1951, pp. 510, 515, 796–798.

*Primary Examiner*—Evan K. Lawrence

*Attorney, Agent, or Firm*—Biebel, French & Nauman

[57] ABSTRACT

A method for making decorative emblems, plaques, or panels comprising flow coating a clear, fluent plastic material onto the surface of a decorated substrate. Flow coating is accomplished with a multiple orifice nozzle (or nozzles) which is passed over the surface of the decorative substrate at a steady speed to give a uniform thickness coating of 0.020 to 0.030 inch. The flow coated fluent plastic is then cured and the coated decorative substrate is stamped to form slightly convex emblems, plaques, or panels.

7 Claims, 7 Drawing Figures

METHOD FOR MAKING DECORATIVE EMBLEMS

CROSS-REFERENCE TO RELATED APPLICATIONS

This is a continuation-in-part of application Ser. No. 903,829, filed May 8, 1978, and now abandoned.

Cross-reference is hereby made to related applications Ser. No. 718,578, filed Aug. 30, 1976, now U.S. Pat. No. 4,034,708 and U.S. Pat. No. 4,100,010, based on application Ser. No. 702,194, filed July 2, 1976, as a continuation-in-part of Ser. No. 478,789, filed June 12, 1974, abandoned.

BACKGROUND OF THE INVENTION

The present invention relates to a method for making decorative emblems, plaques, panels, etc., which have a cured plastic layer over a decorative surface and, more particularly, it relates to a method for flow coating a fluent plastic material onto a decorative substrate to give a uniform thickness coated substrate from which emblems, plaques, or panels are formed.

Decorative plaques and emblems are widely used throughout a number of industries, including the automotive and appliance fields. In the past, a colored vitreous frit was flowed into a bronze substrate and fired at 1250° F. The glass-like vitreous enamel served to beautify the product and protect the decorative substrate from weathering should the plaque or emblem be exposed to the environment.

Today, plastics are primarily used for producing such plaques and emblems. For example, in Loew (U.S. Pat. No. 3,654,062), there is disclosed a process for injection molding a decorative Mylar facing sheet over a vinyl plastic body. The plaque is coated with a layer of protective varnish on the outer surface of the facing sheet. Gits, U.S. Pat. No. 3,246,066, is similar in that male and female molds are used to form a cavity into which a decorative foil is placed and into which a clear plastic material is injected. Prior to injecting a clear plastic material against the front face of the foil, the foil is precoated. Other molding processes, such as compression molding (either one or two shot), are also well known in the art. See for instance, U.S. Pat. Nos. 2,244,565; 2,931,119; 3,075,249; and 3,114,597.

In my U.S. Pat. No. 4,100,010, there is disclosed an improved process for producing decorative emblems. That process involves casting a plastic material onto decorative foil shapes to form a meniscus which when cured gives a lens effect to the top surface of the foil shape. A problem with that process is that despite an ability to vary the size and shape, it is not practical to later conform the as-cast emblem to non-planar surfaces.

Another problem is that the foil shapes are cast individually and the manufacturing process can as a result be too cumbersome and costly for some purposes. Accordingly, the need exists for yet another improved process for producing decorative emblems which is less expensive, more efficient and which yields a product which can be formed to different three-dimensional shapes if desired.

The present invention meets that need by utilizing a flow coating process to apply a clear plastic material to a decorative substrate from which individual emblems and plaques may then be stamped and shaped. Of course, flow coating per se is known in a number of areas. My U.S. Pat. No. 4,034,708 discloses such a process for coating glass containers. As another example, U.S. Pat. Nos. 3,875,893 to Riley and 3,431,889 to Fraatz both disclose flow-coating processes using multiple orifices to lay down a thin film onto a flat surface. But Fraatz and Riley do not relate to emblem or plaque manufacturing processes where a clear plastic is applied to a decorative substrate.

It should also be noted that Hansen in U.S. Pat. No. 3,725,112 mentions flow coating as one of the possible methods for producing his coated or encapsulated substrates. That patent discloses applying a protective low-glare, uniformly textured, transparent, polymeric coating to a substrate such as wood, steel, hardboard, aluminum and the like. Still, the intent of Hansen is to produce textured films having a low-glare surface and not to produce decorative emblems of the type contemplated by the present invention.

Therefore, the need still remains for a method for flow coating clear plastic materials onto a decorative substrate to economically and efficiently produce decorative emblems, plaques, panels, etc.

SUMMARY OF THE INVENTION

The present invention utilizes such a flow coating process to produce decorative emblems in a manner more conducive to mass production than the process of my U.S. Pat. No. 4,100,010. Of course, the depth and beauty of the lens effect achieved by the process of that copending application is not duplicated with the present one. Still, it does have a number of other advantages. Principal among these is the economical and efficient means of production and the ability to apply a smooth coating to a decorated and embossed substrate which may be formed for application to non-planar surfaces.

This latter feature is, in fact, possible because a high meniscus and lens effect are not existent here. Rather, the plastic is of a more flexible variety and is applied in a thinner film which will withstand subsequent shaping operations. And yet, because it is possible with the instant flow coating process to deposit the plastic on the decorative substrate uniformly to a thickness of 0.020 to 0.030 inches, an attractive emblem is still produced.

The substrate upon which the fluent plastic is coated may be a plastic or metal foil, preferably an aluminum foil 0.003 to 0.020 inch thick. The foil substrate is decorated with an appropriate design or series of designs. For example, if a foil sheet or a substantial part of it is to be used as a panel with a minimum amount of trimming after being coated, a single design might be used. More commonly, a series of designs in the form of individual emblems or plaque shapes will be applied to the foil sheet. With a metal foil, the series of designs is preferably applied by silk screen or lithographic printing then the design is enhanced by embossing select areas; although, other means for forming the decorative designs may also be used.

Likewise, it is desirable to prime the top surface of the substrate prior to printing. Any suitable primer may be used such as a silane primer. The decorated-primed substrate is then placed upon a vacuum mat which is situated upon a horizontal vacuum table such as that shhown in U.S. Pat. No. 4,034,708, and assigned to the assignee of this invention. Vacuum is drawn against the bottom surface of the foil through the mat to hold the substrate flat and horizontal.

It is important that the substrate be held flat and horizontal during flow coating because of the fact that the flow characteristics of the fluent plastic and the liquid wettability of the substrate are used to control the spread of the plastic so that it is contiguous with predetermined areas of the foil as well as being uniformly thick. The plastic flow is controlled by use of sharply defined peripheral sides for defined areas of the substrate.

Thus, it is possible to limit the coated areas of a single foil sheet by forming slits, embossed ridges, or other sharp edges in the sheet. When a predetermined amount of fluent plastic is flow coated onto that area, then, it will spread only to the sharply defined peripheral side. In this manner, it is possible to avoid waste by coating only the path directly over the designs from which the emblems or plaques are to be formed, and not wastefully on peripheral areas which are to be discarded.

When waste is not a problem, or when it is inherently encountered (as, for example, when individual emblems are to be stamped out of a larger coated sheet), the use of sharply defined peripheral sides to control plastic flow may be omitted. In those instances it is possible to permit the flow coated plastic to simply flow to its completion, as long as the volume deposited doesn't result in overflow off the sides of the sheet in the first place. The emblems may, then, be stamped out of the uniformly coated portion of the sheet, or the rough, uneven edges trimmed off and the unusable portion of the sheet recycled or discarded. Whether or not sharply defined peripheral sides are used, the flow coating process is the same.

In the present invention, the flow coating is a pathwise disposition. That is, a multiple orifice nozzle (or nozzles) is passed over the decorated-primed surface of the foil at a steady speed as the substrate is held stationary. The number of orifices used may vary depending on the width of the path to be laid down. As an example, a 2.1 inch wide nozzle having 22 orifices of a 0.022 inch I.D. and with a 0.10 inch spacing between the orifices, can be used to lay down a path of 2.4 to 2.5 inches in width.

As can be seen from this example, if such a nozzle is to be used to coat a sheet of greater than 2.5 inches width, then either several nozzles tracking across the sheet in parallel paths must be used or the single nozzle must be programmed to track back and forth across the sheet until the surface is covered with a uniform thickness of the fluent plastic.

The thickness sought is between approximately 0.020 to 0.030 inch. The plastic is preferably a fluent polyurethane of two component parts (polyol and isocyanate) which are mixed immediately prior to coating and cure upon heating. A polyurethane of this type is disclosed in my U.S. Pat. No. 4,100,010. In formulating the particular plastic composition from among those disclosed in that patent, it is important to use a catalyst which results in a somewhat slow curing time in order to allow the flow coated liquid plastic to flow sufficiently, i.e., to the sharply defined peripheral sides if ones are used, before curing is accomplished. Otherwise, it may not be possible to obtain a uniform thickness, smooth coating.

Likewise, the polyurethane may be compounded from among the components listed in the copending application as is known to give a more flexible cured plastic. As along as the bond to the substrate remains strong, it is desirable in this invention to have a somewhat flexible plastic coat so that the emblem, plaque, or panel may be conformed. For example, some decorative automobile panels are applied to a curved surface. With the present invention, it is possible to conform the cured plastic coated panel to that surface.

For most of the types of plastic contemplated, curing will be by irradiation with infra-red or ultra-violet light. The polyurethane compounds mentioned above are heat curable and, thus, infra-red lamps are used; although, obviously other heat sources may also be used. Still, it is desirable to get a through cure, i.e., heat from both the top and bottom of the coated foil. The preferred vacuum table arrangement of U.S. Pat. No. 4,034,708 makes this possible because of a capability of heating or cooling it. However, it has been found desirable to use the infra-red lamps themselves as the heat source for both top and bottom heating. This may be done by using an I.R. absorptive mat as the vacuum mat. The mat will, then pick up heat from the infra-red radiation and conduct it back from the bottom through the coated foil.

After curing, the coated substrate is cooled and removed from the vacuum table. It may at this stage be further processed by cutting, trimming and forming. When individual emblem or plaque shapes are contained on the single sheet, they are stamped out by a cutting die around the particular emblem or plaque shape. It has been found that by die cutting from the bottom surface of the coated foil, it is possible to impart a slightly convex configuration when viewed from the top surface. The convex shape helps give the appearance of a lens effect to the emblem; although, one does not actually exist.

Still, the appearance of the coated emblem is superior to a non-coated one. The luster and beauty of the clear plastic adds considerably to the appearance. It also serves to protect the decorative surface from weathering, chipping, scratching, etc.

Accordingly, it is an object of the present invention to provide a method for making decorative emblems, plaques and panels which have a cured plastic layer over a decorative surface.

It is another object of the present invention to provide a flow coating process whereby a clear plastic layer may be economically and efficiently laid down to a uniform thickness on a decorative substrate from which the emblems, plaques, and panels may be formed.

Other objects and advantages of the present invention will be apparent from the following description, the accompanying drawings and the appended claims.

DESCRIPTION OF THE PREFERRED EMBODIMENTS

Figure 1:
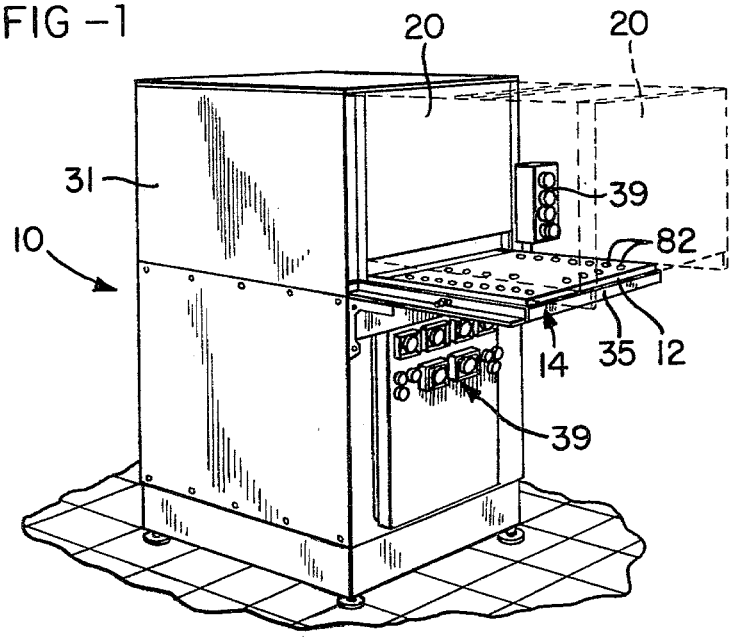
FIG. 1 is a perspective overall view of the preferred apparatus for performing the method of the present invention.

The flow coating process of this invention may be performed with a modified form of the device disclosed in U.S. Pat. No. 4,034,708. An overall view of that device is shown in FIG. 1. As seen there, a foil substrate 12 having a series of emblem design shapes 82 decorated on its surface is positioned on vacuum table 14.

The coating operation utilizes a casting head (not shown in FIGS. 1–2) in the form of a multiple orifice nozzle or nozzles (see FIGS. 3–4) for flow coating measured amounts of a fluent plastic material, such as a fluent polyurethane, to the upper surface of the substrate 12.

Preferred are approximately 100% solid polyurethane resin systems which are catalyzed by mixing two components just prior to casting. In order to promote a rapid curing of the fluent polyurethane system, an infra-red radiation source means for supplying infra-red radiation may be provided to irradiate the polyurethane. Such a source is included in member 20 which is shown extended in FIG. 1 in dashed lines.

Figure 2:
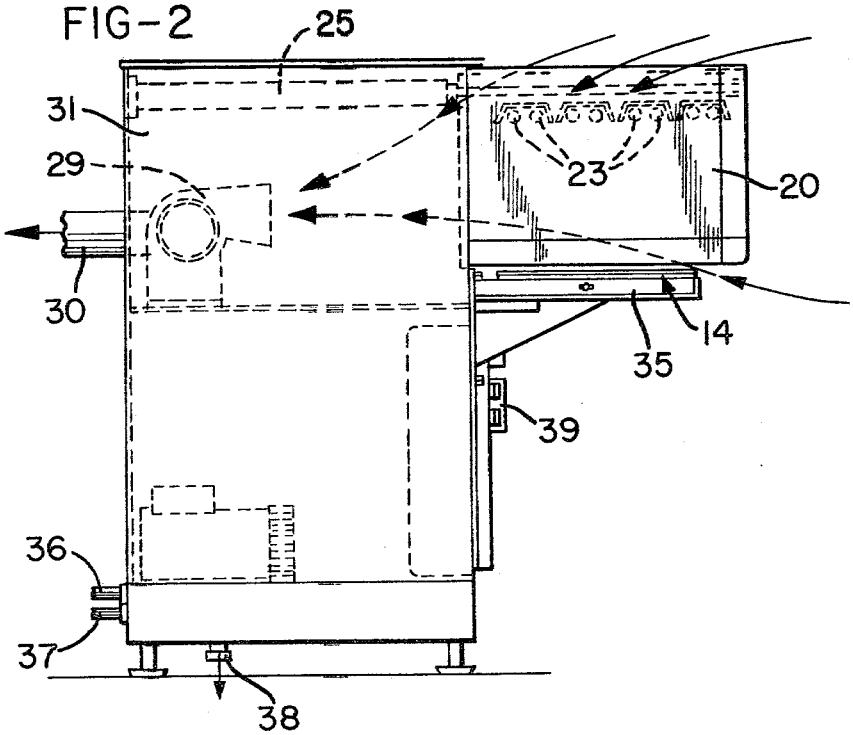
FIG. 2 is a side view of the device.

In the arrangement illustrated in FIGS. 1–2, the source of radiation is moved rather than moving the substrate; although, the reverse situation can also be used. The extended position of the member 20 is shown also in FIG. 2, along with lamps 23 which provide the infra-red radiation. Member 20 is moved by means of air cylinder 25. It should be understood that an ultra-violet curable plastic may also be cast using the device of the present invention; in such a case, lamps 23 would be ultra-violet radiation sources.

While only very small amounts of volatiles will be given off by the plastic during curing, an exhaust means including blower 29, exhaust duct 30, and associated motor (not shown) are provided in order to insure that the operator of the machine does not inhale fumes unnecessarily. As illustrated in FIG. 2, ambient air is drawn into the cabinet 31 by fan 29. The air will be drawn over the top of the platen means 35. The air will also be drawn past the lamps 23 preventing fumes from escaping upwardly through member 20 and also cooling lamps 23.

It may be desirable to control the temperature of the substrate prior to and during the casting and curing process. Under some circumstances, it may be desirable to maintain the substrate at one temperature during casting and a portion of the curing process, and then to maintain the substrate at a second temperature. Toward this end, water inlets 36 and 37 and one or more outlets 38, are provided to receive and discharge water supplied at more than one temperature.

It may also be desirable to irradiate the substrate prior to the casting process, such that the substrates are heated and the viscosity of the cast plastic reduced as it flows onto the substrates. This reduction in viscosity will cause the plastic to flow more evenly over a larger foil substrate. Since it is desirable to be able to change readily the sequence of steps and the order of these steps, a number of timers and controls shown generally at 39 are provided. Vacuum pump 41 is also provided to supply a vacuum platen 35 with a vacuum.

Figure 3:
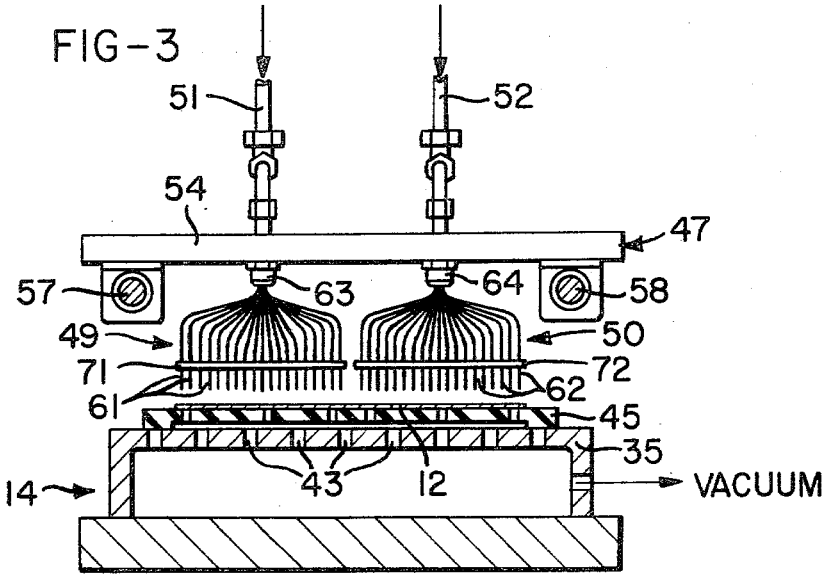
FIG. 3 is a view illustrating the coating nozzle arrangement for performing the method of the present invention.

The use of a vacuum to hold substrate 12 flat and horizontal is better shown in FIG. 3. Thus, vacuum pump 41 draws a vacuum through holes 43 in platen 35. This serves to hold vacuum mat 45 onto the platen since the holes in vacuum mat 45 are not aligned with those in platen 35. The vacuum mat 45 may be a perforated one-fourth inch thick silicone rubber mat. Since it is perforated, the vacuum from platen 35 will also be drawn through mat 45 against substrate 12.

FIG. 3 also shows in detail casting head 47 having two nozzles 49 and 50. Each nozzle is fed a supply of fluent plastic such as a liquid polyurethane. Preferred is a mixture of "A" and "B" components of the type disclosed in my U.S. Pat. No. 4,100,010. Basically, that mixture is one of a polyether polyol component ("A"), which may be a difunctional, trifunctional and/or tetrafunctional polypropylene glycol containing a suitable catalyst, and a diisocyanate component ("B") such as an aliphatic diisocyanate. A catalyst such as a lead or mercury material is used since it promotes a slow cure at room temperature so as to allow time for full flow of the liquid polyurethane before setting. As stated in U.S. Pat. No. 4,100,010, which is specifically incorporated herein by reference, an example of the diisocyanate is Hylene W from E. I. duPont de Nemours and Co., and the polyether polyol may be one or more of the Pluracol materials (P-410 or TP-440) from BASF Wyandotte. It may also be a polyether-polyester polyol combination, use of the polyester polyol making the cured polyurethane more flexible. The ratio of components A:B is preferably 50–60:40–50. A polyester polyol or polyactone polyol could be used in place of the polyether polyol.

The mixture of "A" and "B" components of this type cures, through catalytic action, under heat such as produced by infra-red radiation. Accordingly, this type of arrangement will be disclosed as the preferred embodiment; although, single component, photocurable, polyurethanes of known types could also be used.

Tanks (not shown) store the "A" and "B" material separately prior to mixing, then, feeding to supply lines 51 and 52 for nozzles 49 and 50. Nozzles 49 and 50 are mounted on carriage 54 which is slidably mounted on rods 57 and 58 for motion over the surface of substrate 12 as indicated by the arrows in FIG. 4. Each nozzle has multiple orifices in the form of tubes 61 and 62. Fittings 63 and 64 connect each of the multiple orifice nozzles 49 and 50 to supply lines 51 and 52.

The number of tubes 61, 62 and the spacing between the tubes in an individual nozzle will vary in dependence on the width of the portion of the substrate to be coated. It has been found, however, that between 10 and 26 tubes, spaced apart approximately $\frac{1}{8}$ to 1/10 inch, may be used for each nozzle means in the present embodiment. The tubes preferably have 0.022" I.D. and a 0.039" O.D. Spacer bars 71 and 72 hold the tubes 61 and 62 spaced apart at desired distances, preferably 0.10 inch. For application of a uniform thickness coating across each of the two zones of approximately 2.4–2.5 inches in width each, 22 tubes are used in each nozzle 49 and 50. The 22 tubes have a combined width of approximately 2.1 inches.

Figure 4:
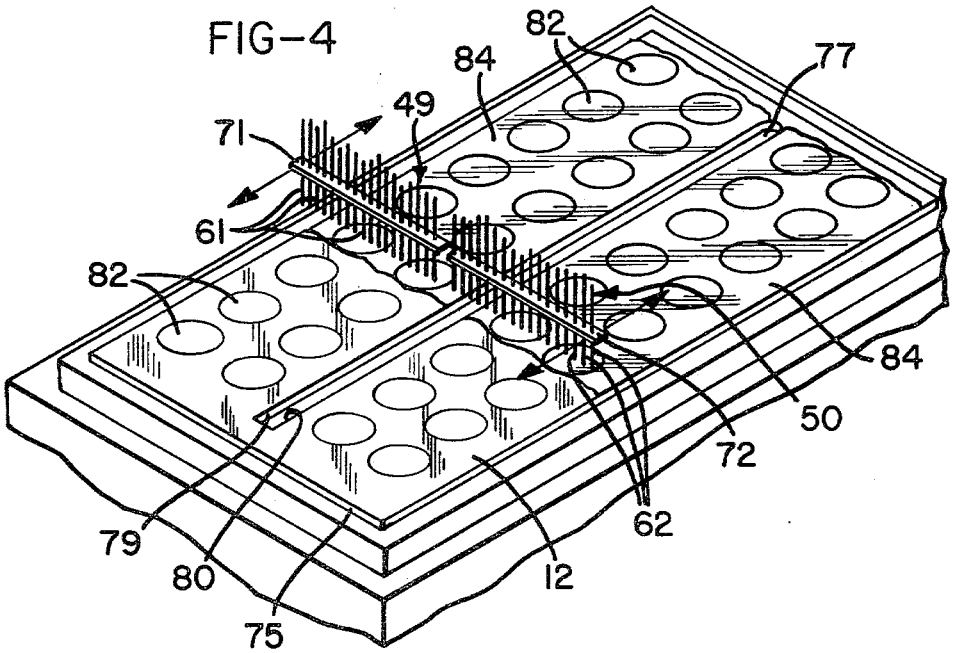
FIG. 4 is a perspective view of the coating arrangement for performing the method of the present invention.

The operation of casting head 47 is better understood with reference to FIG. 4. Pneumatic or hydraulic controls (not shown) drive casting head along the length of stationary substrate 12 as indicated by the arrows. A return movement, also as indicated, takes place after completion of flow coating onto one decorative substrate and the casting head is in position to repeat the process for another decorative substrate. As the casting head 47 begins its initial track over substrate 12, starting at approximately 0.15 to 0.20 inch from the edge 75, the liquid polyurethane flows from tubes 61, 62 at a uniform flow rate. Since the movement of casting head 47 over stationary substrate 12 is at a steady speed, there is laid down a uniformly distributed amount of liquid polyurethane.

That fluent plastic then flows to complete the coverage of the portion of the surface desired. A uniform thickness of plastic results. The speed of casting head movement and coating rate for the plastic depend upon the area to be covered, the number of tubes used, the viscosity of the fluent plastic, etc. Generally, however, it is possible to easily adjust these variables in order to achieve a coating of the thickness desired. The desired thickness is 0.020 to 0.030 inch.

The wettability characteristics of the fluent plastic are such that it only partially wets the surface of substrate 12 and will flow on the surface of the substrate. Under heating, the viscosity of the polyurethane becomes lower until gelation begins and flow slows. Upon reaching a sharply defined peripheral side if ones are used, this flow will be halted. If the edge is verticle, the flowing liquid plastic wants to maintain a given contact angle at that edge (specified by the interface properties of the plastic and the foil). As long as the internal pressure (hydrostatic) of the plastic does not exceed the surface tension at that contact angle, the liquid plastic will not overflow the side.

Accordingly, it is desirable in this embodiment to form sharply defined peripheral sides intersecting with the top planar surface around each area to be coated. In FIG. 4, there are two paths which are to be uniformly coated, one beneath nozzle 49 and one beneath nozzle 50. The line between these paths is slit 77 which forms sharp peripheral sides 79 and 80. The ordinary four edges of substrate 12, then complete the formation of the two paths. Of course, other arrangements may be used to form the sharply defined peripheral sides, such as by embossing ridges in the sheet.

It is also possible to coat the whole surface of substrate 12 since its four edges are sharply verticle. However, it may be advantageous in terms of eliminating excess scrap and waste to form paths in the manner mentioned. Those paths, then, will be over only those areas of the substrate from which emblems or plaques are to be formed.

Finally, it is possible, as mentioned previously, to forego use of sharply defined peripheral sides to control the plastic flow. A finite amount of properly formulated plastic flow coated onto a substrate using an applicator such as nozzles 49 and 50 will flow to form a uniform 0.020–0.030 inch layer, at least in the central area of the deposit. While the edges may be non-uniform and uneven, these can be trimmed off or simply wasted after stamping the emblem out of the uniformly coated portion of the substrate.

Figure 5:
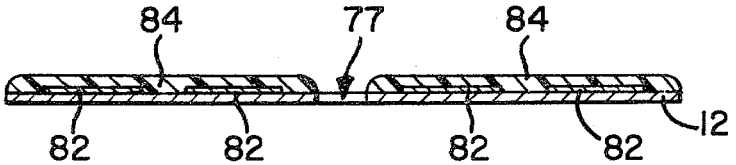
FIG. 5 is a cross-sectional view of the coated sheet of FIG. 4.

In FIGS. 4–5, the emblems are represented by emblem design shapes 82. It is desirable to prime the substrate with a silane before printing. As an example, a mixture of approximately 2% castor oil (Surfactol from The Baker Castor Oil Co.) and up to approximately 2% silane (Dow 6020, 6040, or 6075 from Dow Corning Corp., which are respectively, 3-(2-amino-ethylamine) propyltrimethoxysilane, glycidoxypropyltrimethoxysilane, and vinyltriacetooxysilane) in a solvent (70% isopropyl alcohol and 30% octane) may be used. Other known silane primers may also be used. The primers may be pre-applied by spraying, dipping, or roller-coating, followed by drying to remove the solvent.

Next, the design shapes are decorated onto substrate 12. With a metal foil, silk-screen printing and embossing are the usual methods. Thus, an aluminum foil from 0.003 to 0.020 inch thick may be silk-screen printed and embossed in selected areas to provide a series of emblem design shapes as at 82.

The fluent plastic is then flow coated onto the substrate 12 as described. Next, the substrate is heated with infra-red lamps 23, also as described, in order to cure the plastic.

A feature of the present invention is the use of vacuum mat 45 to aid in that curing process. That is, by using an infra-red absorptive mat, such as a one-fourth inch thick silicone rubber mat, heat is absorbed by the mat and re-radiated back through substrate 12 to give a through cure.

Figure 6:
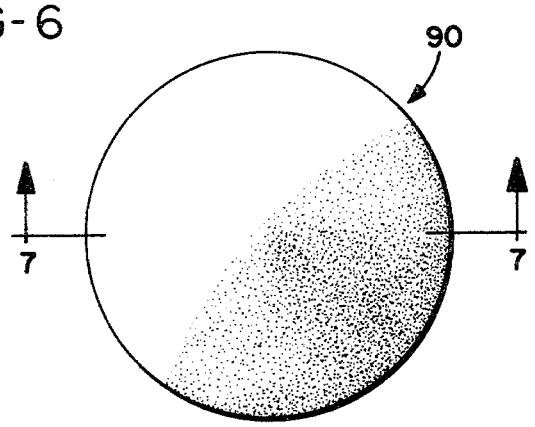
FIG. 6 is a top plan view of a single emblem stamped from the coated sheet of FIGS. 4 and 5.
Figure 7:
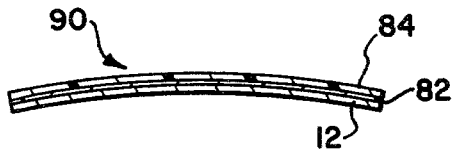
FIG. 7 is a cross-sectional view along line 7—7 of FIG. 6.

Once the curing is accomplished and the coated substrate cooled, plastic layer 84 is adhered to substrate 12 sufficiently to permit further processing. In the case of panel production, that may involve only minor amounts of trimming, cutting and forming. With emblem production as shown, a die is used to cut around each emblem design shape 82 to form individual emblems 90 (See FIG. 6). By die cutting from the bottom (uncoated) side 86 of substrate 12, a slight convex shape is given to each emblem 90 (See FIG. 7).

The emblems 90 may then be adhesively applied into or onto the intended surface. They may also be placed in a retaining frame which is used to affix the emblem 90 onto the surface. Finally, it is noted that since the fluent plastic may be compounded as described to give a somewhat flexible material when cured, forming other than merely die cutting may be undertaken. The emblem 90, and more often panels, may be conformed to non-planar surfaces as long as the degree bending for the conformity required is not too severe.

While the preferred embodiment just discussed utilizes a two-nozzle casting head as shown in FIGS. 3–4 which makes a single pass over substrate 12, it should be emphasized that a single multiple orifice nozzle may be used for a narrower application path or additional nozzles may be added to casting head 47 to give a wider application path. Likewise, the number of tubes used with each nozzle may be varied to vary the width of the application path.

Another embodiment involves use of a single nozzle of the type shown for coverage of a substrate of varying widths. It is mounted on a carriage of the same width which only tracks back and forth longitudinally over the length of substrate 12. Also, the nozzle is movable laterally on the carriage. After each pass and on the return route, the nozzle moves laterally one nozzle width (plus approximately 0.15–0.20 inch). Another pass begins. This is repeated until the full expanse of the substrate has been coated. In each case, a timing mechanism is necessary to start and stop flow of the liquid plastic during a single pass. A delay timer is provided to permit the lateral movement of the nozzle after the plastic flow has stopped and prior to the start of plastic flow after the lateral movement of the nozzle is completed.

EXAMPLE

In this example, a single nozzle having 22 tubes as described was used to flow coat a substrate of approximately 2.5″×24″ in a single pass. The substrate was 0.015 inch thick aluminum foil which had been cleaned, primed, silk-screen printed and embossed with a series of circular emblem designs approximately $1\frac{1}{8}''$ in diameter.

The 22 tube nozzle had a width of approximately 2.1 inches and was centered over the 2.5 inches wide substrate to leave margins of approximately 0.20 inch. Starting 0.20 inch from one end of the foil, which was held flat and horizontal on a vacuum mat as described. A steady speed of 3.2 inches per second was used. Clear liquid polyurethane was flowed from the nozzle at the uniform rate of 210 grams per minute.

The liquid polyurethane was a mixture of "A" and "B" components and had a density of 17.39 grams/cubic inch. The "A" component was itself a mixture of polyester polyol and polyether polyol and contained a lead octoate catalyst. The "B" component was a mixture of polypropylene glycol and an aliphatic diisocyanate. The ratio of "A" to "B" was 54.4% to 45.5%.

It took the nozzle 7.43 seconds to transverse the 24" length of the aluminum foil (stopping 0.20 inch from the end). In the process, 26 grams of liquid polyurethane were deposited onto the foil at a uniform thickness of 0.025 inch±0.005 inch.

After flow coating, the coated foil was heated under four 1600 watt infra-red lamps at a distance of 12" to 10 minutes. This was followed by cooling the vacuum table with 60° F. water for 2 minutes. After cooling, representative ones of the emblem shapes were die cut from the foil by applying a die to the bottom (uncoated) surface of the foil.

The emblems had a slightly convex shape when viewed from the front surface, and were lustrous in appearance. The cured plastic was bound firmly to the decorative substrate and provides a tough, resistant protective coating in addition to beautifying and design.

While the method herein described constitutes a preferred embodiment of the invention, it is to be understood that the invention is not limited to this precise method, and that changes may be made therein without departing from the scope of the invention.

What is claimed is:

1. A method for producing decorative emblems, plaques or panels, comprising:

(a) providing a substrate having a top surface and a bottom surface and a series of designs applied to its top surface, said substrate having formed therein slits, embossed ridges, or other sharp edges so as to provide within the substrate and around each area to be coated sharply defined peripheral sides which intersect with said top surface, (b) holding said substrate flat and horizontal on a supported surface free from surrounding side walls, (c) flow coating a clear viscous fluent curable plastic onto said top surface of said substrate from multiple orifices such that the area coated includes said designs, said plastic being one which only partially wets the surface of said substrate and which is sufficiently slow curing that it will flow on said substrate to said sharply defined peripheral sides without flowing over said sharply defined peripheral sides said plastic being applied in an amount sufficient to form a uniform thickness coating approximately 0.020 to 0.030 inch thick, (d) allowing said fluent plastic to cure while maintaining said substrate flat and horizontal to bond said uniformly thick coating to said substrate, and (e) stamping said emblems, plaques, or panels out of said substrate having said cured plastic thereon by application of a cutting die to said bottom surface of said substrate so as to cut contiguous with each individual design of said series of designs, and impart a slightly convex shape to each said emblem, plaque or panel when viewed from the top surface thereof.

2. The method of claim 1 wherein said substrate is an approximately 0.003 to 0.020 inch thick metal foil.

3. The method of claim 2 wherein said metal foil is primed prior to the application of said series of designs.

4. The method of claim 3 wherein said fluent plastic is cured by heating under infra-red lamps.

5. The method of claim 4 wherein said substrate is held flat and horizontal on a vacuum mat which also serves as a heat sink during the heat curing of said fluent plastic.

6. The method of claim 3 wherein said metal foil substrate is silk-screen printed and embossed to form said series of designs thereon.

7. A method for producing a number of decorative emblems from a single sheet of aluminum foil, comprising:

(a) providing an approximately 0.003 to 0.020 inch thick aluminum foil having a top surface and a bottom surface, (b) applying a primer to said top surface of said aluminum foil prior to screen printing, (c) silk-screen printing and embossing said surface to form a series of individual decorative emblem shapes thereon, said foil having formed therein slits, embossed ridges or other sharp edges so as to provide within said foil and around each area to be coated sharply defined peripheral sides which intersect with said top surface, (d) allowing the printed decorations to set prior to placing the bottom side of said aluminum foil on top of a vacuum mat on a horizontal vacuum table, (e) applying a vacuum draw to said bottom surface of said aluminum foil through a vacuum mat to hold said aluminum foil flat and horizontal, (f) flow coating a clear viscous curable polyurethane in liquid form onto said top surface of said aluminum foil by passing multiple orifices over said top surface at a steady speed as said aluminum foil is held stationary and constantly ejecting liquid polyurethane from each of said orifices during the passage such that the area coated includes said emblems, said polyurethane being a plastic which only partially wets the surface of said aluminum foil and which is sufficiently slow curing that it will flow to said sharply defined peripheral sides without flowing over said sharply defined peripheral sides, said polyurethane being applied in an amount sufficient to form a uniform thickness coating of approximately 0.020 to 0.030 inch thick, (g) heating the coated aluminum foil under infra-red lamps while said aluminum foil is maintained flat and horizontal to cure said liquid polyurethane and bond it to said aluminum foil, (h) cooling and removing the coated aluminum foil from said vacuum mat; and (i) stamping individual emblems from said aluminum foil by application of a cutting die contiguous with each of said emblem shapes to the bottom surface of said aluminum foil so as to impart a slightly convex shape to each individual emblem when viewed from the top surface thereof.

* * * * *